US005308011A

United States Patent [19]

Roman

[11] Patent Number: 5,308,011

[45] Date of Patent: May 3, 1994

[54] SUPPORTING SIDE FOR A HOSE-WINDING DRUM FOR A DEVICE FOR WINDING FLEXIBLE HOSE

[75] Inventor: Gianfranco Roman, Pasiano, Italy

[73] Assignee: Claber S.p.A., Italy

[21] Appl. No.: 915,541

[22] Filed: Jul. 20, 1992

[30] Foreign Application Priority Data

Jul. 31, 1991 [IT] Italy ..... MI91A002134

[51] Int. Cl.[5] ..... B65H 75/34

[52] U.S. Cl. ..... 242/86; 242/86.2

[58] Field of Search ..... 242/85, 86, 86.1, 86.5 R, 242/115, 116, 117, 118.4; 137/355.26, 355.27

[56] References Cited

U.S. PATENT DOCUMENTS

| | | | |
|---|---|---|---|
| 2,155,769 | 4/1939 | Porter | 242/86.5 R |
| 4,137,939 | 2/1979 | Chou | 242/86.2 X |
| 4,512,361 | 4/1985 | Tisbo et al. | 242/86 X |
| 4,706,906 | 11/1987 | Roman et al. | 242/86 |
| 4,752,047 | 6/1988 | Franks, Jr. | 242/129.6 |
| 4,768,546 | 9/1988 | Brusadin et al. | 242/86 X |
| 4,777,976 | 10/1988 | Johnston et al. | 137/355.27 |
| 4,913,580 | 4/1990 | Whitehead | 403/326 |
| 5,007,598 | 4/1991 | Spear | 242/86 X |

FOREIGN PATENT DOCUMENTS

| | | | |
|---|---|---|---|
| 2415596 | 8/1979 | France | 137/355.26 |
| 2507584 | 12/1982 | France | 242/86.2 |

*Primary Examiner*—Daniel P. Stodola
*Assistant Examiner*—John P. Darling
*Attorney, Agent, or Firm*—Nixon & Vanderhye

[57] ABSTRACT

Supporting side for a hose-winding device. The side has a plurality of parallel ribs and, perpendicularly to them, successions of slots alternated with successions of stiffening elements formed by sections of wall alternated inward and outward from the hose-winding device and provided with stiffening ribs. In the side there are seats for the introduction of ends of a handle element and of a base element. In it there are also a snap-on coupling of a hub of a hose-winding drum and a snap-on coupling for a shaft supporting a pair of wheels.

9 Claims, 6 Drawing Sheets

100
102
104
103
104
105
107
105
11
7
110
1
105
108
105
106
115
9
14
105
3
113
111
3
130
29
112
13
8
12
101
8

SUPPORTING SIDE FOR A HOSE-WINDING DRUM FOR A DEVICE FOR WINDING FLEXIBLE HOSE

BACKGROUND

I. Field of the Invention

The present invention relates to a supporting side for a hose-winding drum for a device for winding flexible hose.

II. Related Art and Other Considerations

Devices are known for winding flexible hose wherein a rotating drum destined to receive the flexible hose is supported by a tubular metal structure formed by a base part (possibly provided with wheels) and by a top part (acting as a gripping and operating element).

The two tubular structure parts are substantially conformed in a U-shape and have suitably located bends. The two tubular structure parts are joined together and to the rotation pivot of the hose-winding drum at a pair of couplings, generally of plastic material, located at the two sides of the drum. Each of such couplings receives one end of each of the two parts of tubular structure and, perpendicularly, the drum's rotation hub, thus defining a single structure for supporting the drum.

Couplings for supporting the hub in plastic material are currently known. Such couplings have been formed by two equal side-by-side elements, each having a closed hole seat (for receiving the end of a respective part of the tubular structure) and an open perpendicular half-seat co-operating with the corresponding half-seat of the other element (for receiving the drum's rotation hub).

Couplings for supporting the hub are also constituted by a single element with an elongated shape. The element has ends respective aligned closed hole seats for receiving the respective ends of parts of a supporting tubular structure that can be connected together and through which a perpendicular hole is drilled for receiving a rotation hub.

These latter couplings are of extremely simple construction. They may be assembled easily and quickly for connecting together tubular structures and the support of a rotation hub, such as that of the rotating drum of a hose-winding cart.

The aforementioned couplings do, however, require the handle element, in addition to the bends necessary for forming the U, to also have a pair of bends such as to allow it (1) to be inserted in the coupling in a direction substantially perpendicular to the ground, and then (2) to extend transversally to it and either upward or downward with an optimum inclination so as to allow an easy pushing or grasping action of the hose-winding device and its stable positioning on the ground, respectively.

An object of the present invention is to provide a supporting side for a hose-winding drum for a device for winding flexible hose. The supporting side of the present invention executes the same function as the aforementioned couplings and is shaped so as to receive (on one side) a tubular base element and (on the other side) a tubular handle element, both in the shape of a U but with no other additional bends.

Another object is to provide a side with the minimum use of material and thus extremely light, but all the same suitable for resisting the various deflection and torsion forces.

SUMMARY

According to the invention such objects are attained through a supporting side for a hose-winding drum for a device for winding flexible hose, characterized in that it has a plurality of parallel ribs and, perpendicularly to them, successions of slots alternated with successions of stiffening elements formed by sections of wall alternated inward and outward from the hose-winding device and provided with stiffening ribs.

Lightness and economy of the material used are thus obtained, with consequent decreased costs, as well as excellent resistance to deflection and torsion stresses.

At the same time a suitable shape of the side allows the use of U-shaped tubular metal elements, thus with no additional bends, both for the base and for the handle, with the consequent reduction in production times and of related costs, as well as with an obvious saving in storage space.

BRIEF DESCRIPTION OF THE DRAWINGS

The features of the present invention shall be made more clear by the following detailed description of an embodiment thereof illustrated as a non-limiting example in the enclosed drawings, wherein.

DETAILED DESCRIPTION OF THE DRAWINGS

Figure 1:
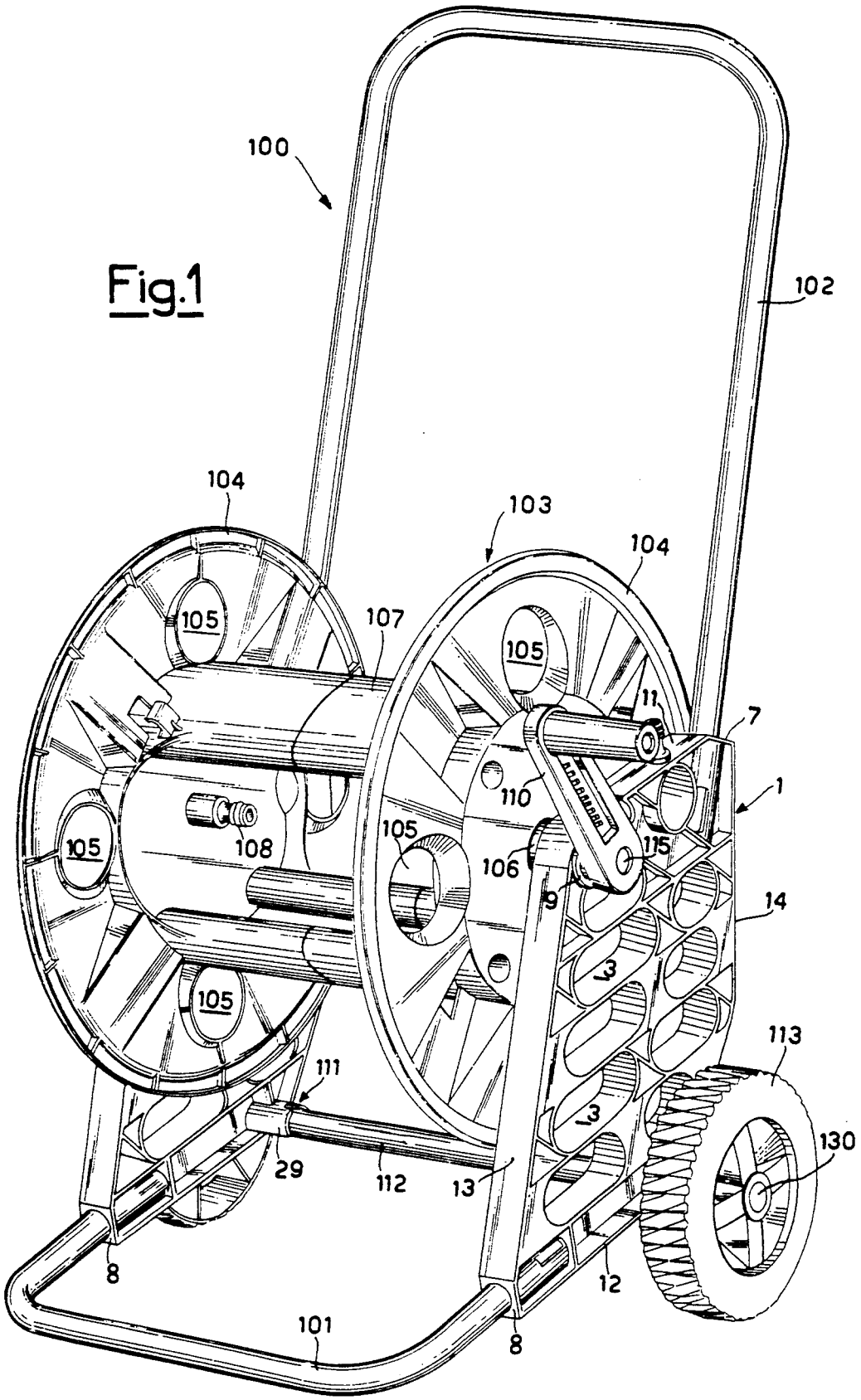
FIG. 1 is an overall perspective view of a hose-winding cart provided with sides according to the present invention.
Figure 2:
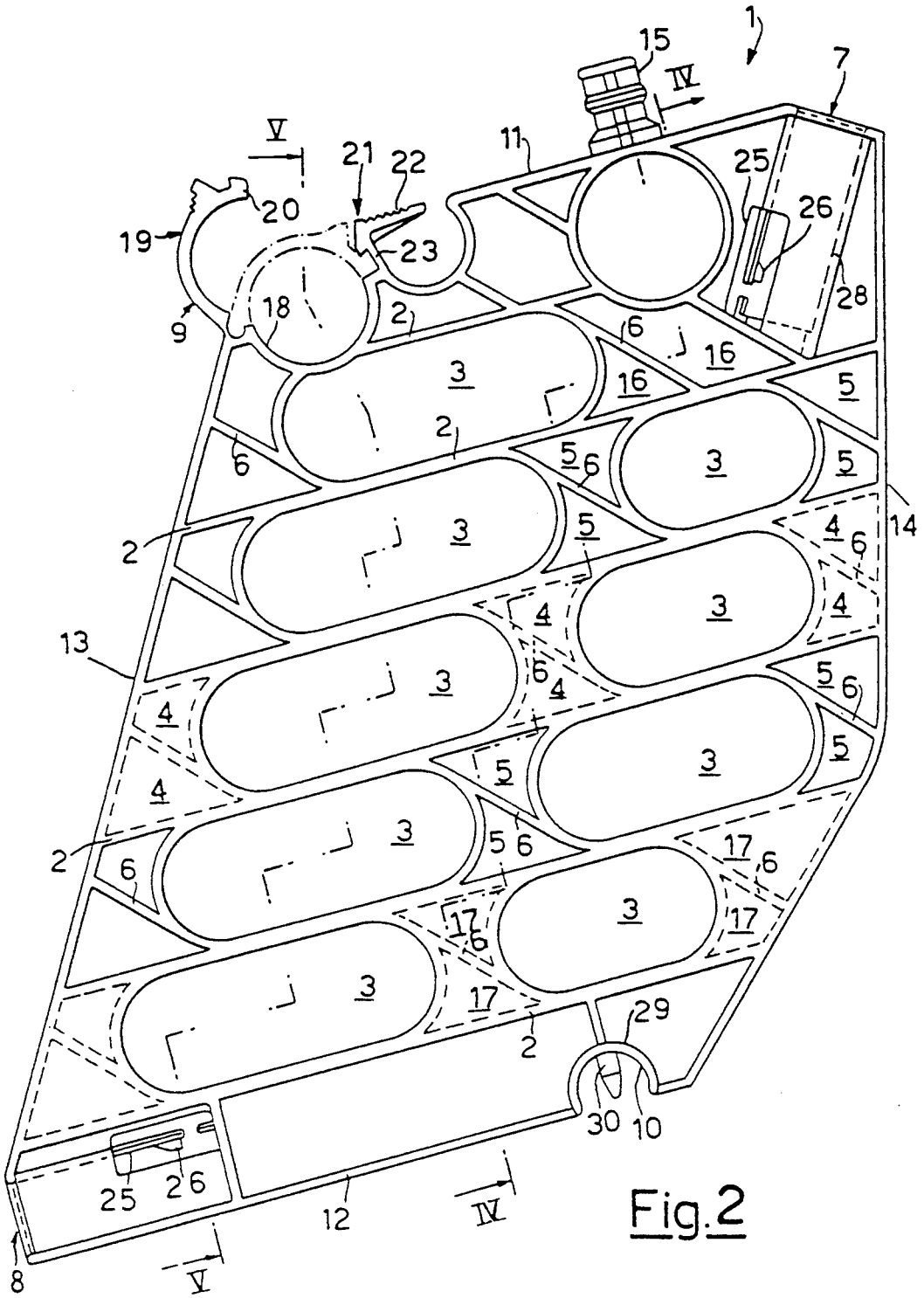
FIG. 2 is a lateral view of a side according to the present invention.
Figure 3:
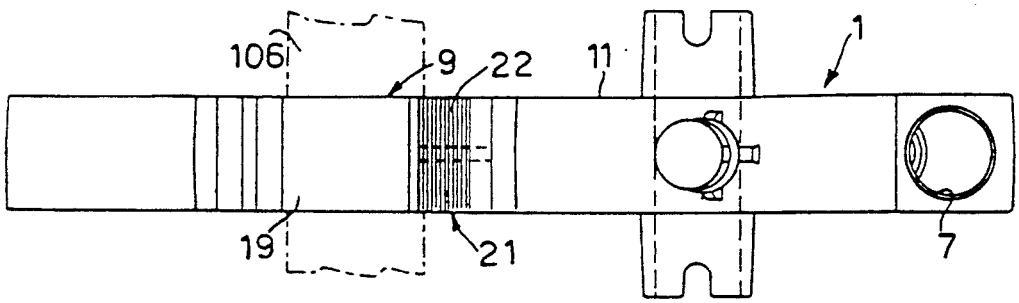
FIG. 3 is a plan view from above of the side of FIG. 2.
Figure 5:
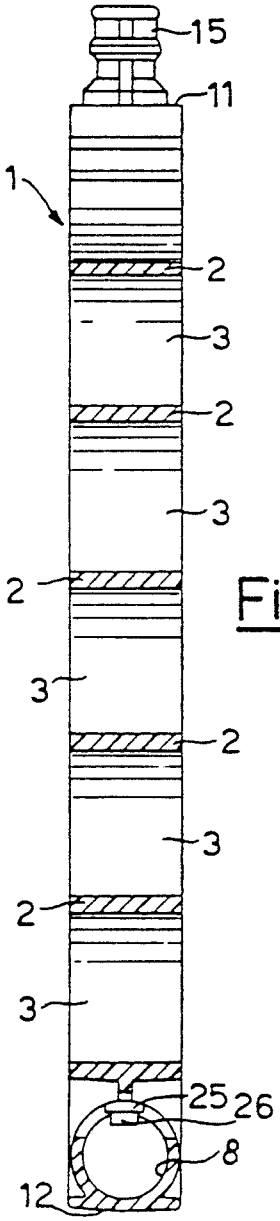
FIG. 5 is a cross-sectional view taken along the line V—V of FIG. 2.
Figure 4:
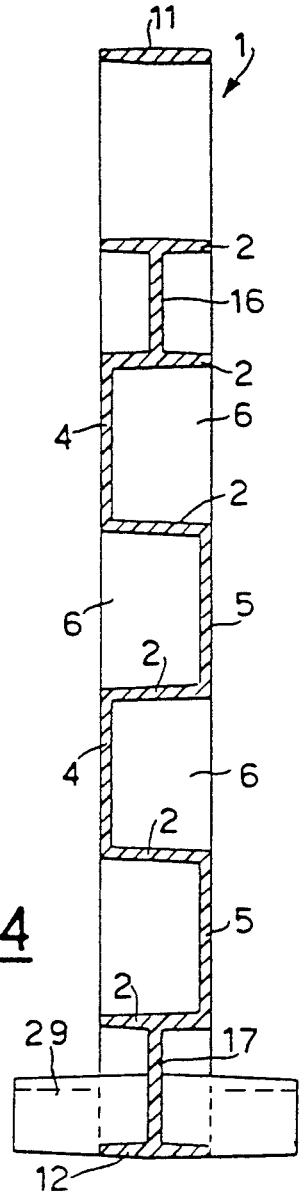
FIG. 4 is a cross-sectional view taken along the line IV—IV of FIG. 2.

With reference to FIG. 1, a hose-winding cart (indicated as a whole with the numerical reference 100)

comprises a structure formed by a tubular metal base element 101 and by a tubular metal handle element 102 bent in a U-shape and inserted (at the free ends) in seats 7, 8, respectively, formed inside supporting sides 1 for a rotating hose-winding drum 103.

The hose-winding drum 103, made entirely of plastic, is formed by a pair of flanges 104, with lightening holes 105, and by connecting cross-pieces 107 suitable for connecting the flanges 104 together. From one of the two flanges 104 there protrudes laterally and toward the inside a male fitting element 108 to which there may be connected a female fitting element suitably fastened to an irrigation line that may be wound onto the drum 103 over the set of cross-pieces 107. The male element 108 communicates with a similar male fitting element (not shown) protruding from the opposite part of the same flange 104 and suitable for the connection, by means of a female fitting element, to a flexible hose connected to a water outlet. From the flanges 104 there protrude laterally hubs 106 suitable for being supported, with the interposition of bushings 24 (FIGS. 6–8), in suitable couplings 9 obtained in the sides 1.

Figure 8:
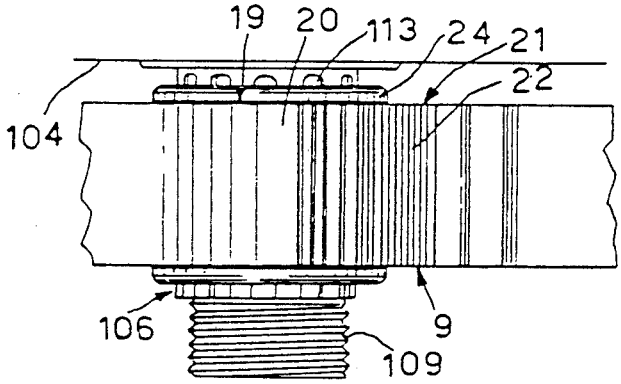
FIG. 8 is a plan view from above of the detail of FIG. 6.
Figure 9:
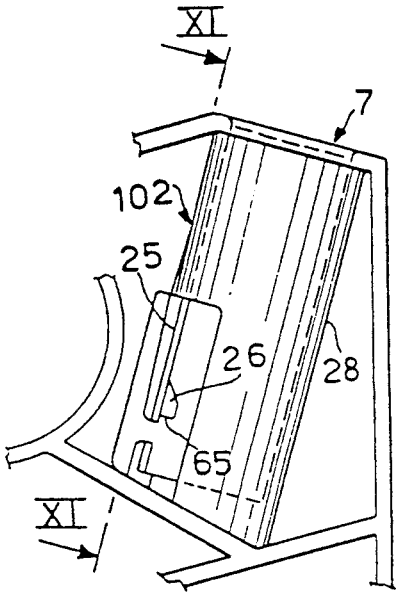
FIG. 9 shows a detail of the side of FIG. 2 corresponding to a snap-on coupling of one end of a handle element, or alternatively of a base element.
Figure 13:
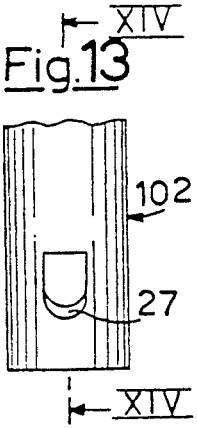
FIG. 13 shows an end of a handle element, or of a base element.
Figure 14:
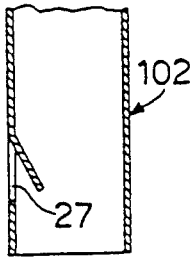
FIG. 14 is a cross-sectional view taken along the line XIV—XIV of FIG. 13.
Figure 12:
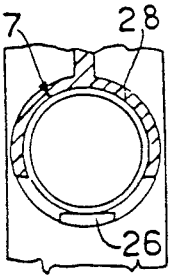
FIG. 12 is a cross-sectional view taken along the line XII—XII of FIG. 11.
Figure 11:
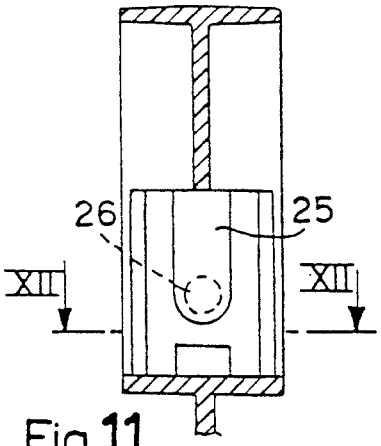
FIG. 11 is a cross-sectional view taken along the line XI—XI of FIG. 9.
Figure 10:
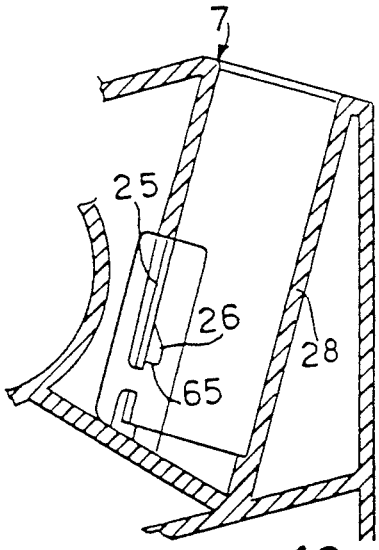
FIG. 10 shows the same detail of FIG. 9 in an axial cross-section.
Figure 15:
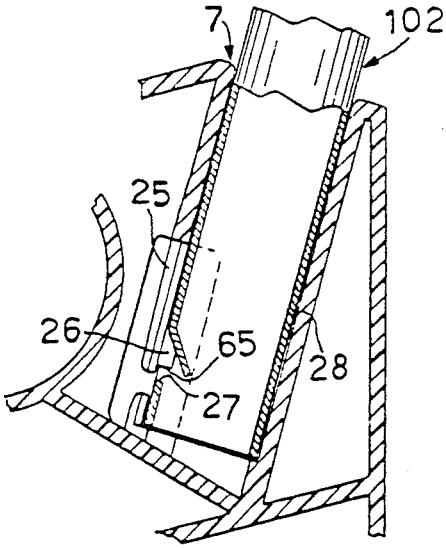
FIG. 15 is a cross-sectional view showing the handle element of FIG. 14 inserted in the coupling of FIG. 10.

The hubs 106 have by an externally-grooved internal portion 113 and by an externally-threaded external portion 109, visible in FIG. 8. On the externally-threaded portion 109 of one of the hubs 106 is screwed a handle 110 (FIG. 1) used for rotating the drum 103.

Opposite the base element 101, the sides 1 have snap-on couplings 29, comprised of laterally protruding semi-cylindrical sleeves, each provided with a centering pin 31 (FIGS. 16 and 17) for a shaft 112 supporting a pair of wheels 113.

One of the two sides 1 supporting the hose-winding drum 103 is represented in detail in FIGS. 2–5. The side is made in a substantially trapezoidal like shape with a plastic beehive structure and has a pair of base and top sides 12, 11, respectively, and lateral sides 13, 14.

In a direction parallel to the sides 11, 12 there extends a plurality of parallel horizontal ribs 2. In a direction perpendicular to sides 11, 12 extend vertical successions of slots 3 alternated with vertical successions of stiffening elements (formed by wall sections 4,5, respectively), alternated outwardly and inwardly.

The slots 3 arranged in the proximity of the base side 12 and of the top side 11 are respectively alternated with wall sections 16, 17 arranged in an intermediate position with respect to the surface of the side 1.

The wall sections 4, 5, 16, 17 are in turn provided with stiffening ribs 6.

At the intersection between the top wall 11 and the side 14, and also at the intersection between the base wall 12 and the side 13, there are the seats 7, 8, that are identical to one another. The choice of positioning the seat 7 at an angle with respect to the top wall 11 and to the side 14 allows use to be made of single-bend tubes (U-shaped) for the handle elements 102 instead of tubes provided with transversal bends as well. This fact simplifies substantially the manufacture of said elements during the construction stage.

At the intersection between the side 13 and the top wall 11 there is the coupling 9; at the intersection between the base wall 12 and the side 14 there is also the coupling 29.

From the top wall 11 there further protrudes a tang 15, shaped like a male fitting element, that may be used for connecting to the female fitting in the section of the irrigation line that is normally connected to the water supply.

Figure 6:
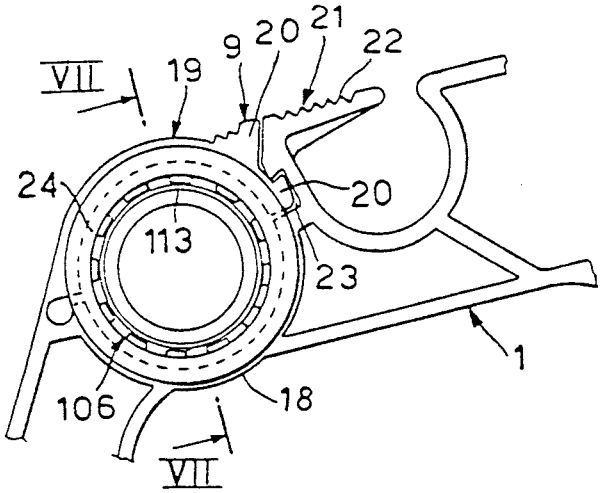
FIG. 6 shows a detail of the side of FIG. 2 corresponding to a coupling for the hub of a hose-winding drum.
Figure 7:
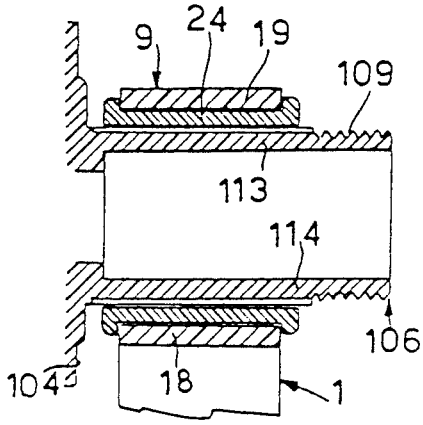
FIG. 7 is a cross-section taken along the line VII—VII of FIG. 6.

FIGS. 6, 7, and 8 show enlarged detail of the snap-on coupling 9. C/upling 9 comprises a semicircular seat 18 suitable for receiving, with the interposition of a bushing 24, the hub 106 of the drum 103 and of an appendix 19 provided with a protrusion 20. To the circular half-seat 18 there is also connected an elastic holding element 21 provided with a notch 23 complementary to the protrusion 20 and with an appendix 22 aligned with the top wall 11. The appendix 19 may be displaced from a position where the coupling 9 is open, illustrated in FIG. 1, to a position where the same is closed round the bush 24 with the protrusion 20 inserted in the notch 23 (FIG. 6) exploiting the flexibility of the appendix 22. In turn the appendix 22 is suitable for operating the disengagement of the protrusion 20 from the notch 23 to cause the coupling 9 to reopen.

FIGS. 9–15 show the enlarged detail of the seat 7 for the introduction of an end of the handle element 102. The seat 8 for the introduction of an end of the base element 101 is altogether equivalent.

The seat 7 comprises a cylindrical surface 28 and a tang 25 that ends with a tooth 26 suitable for being inserted in a corresponding cavity 27 obtained in the end of the handle element 102 for their reciprocal locking in position. It should be noted that the tooth 26 has a perpendicalar front 65 suitable for preventing the handle element 102 from accidentally slipping off.

Figure 17:
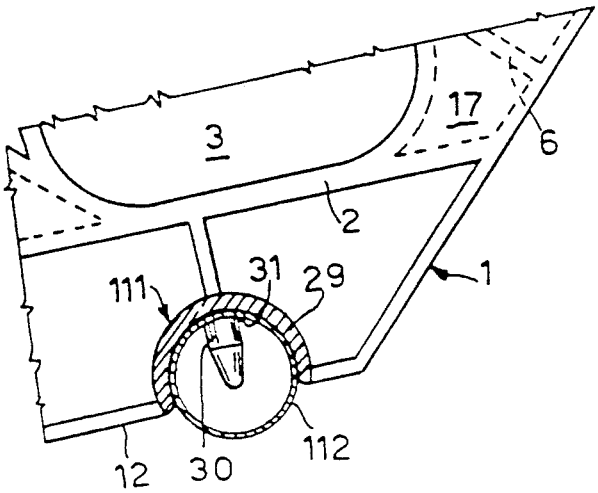
FIG. 17 is a cross-sectional view taken along the line XVII—XVII of FIG. 16.
Figure 16:
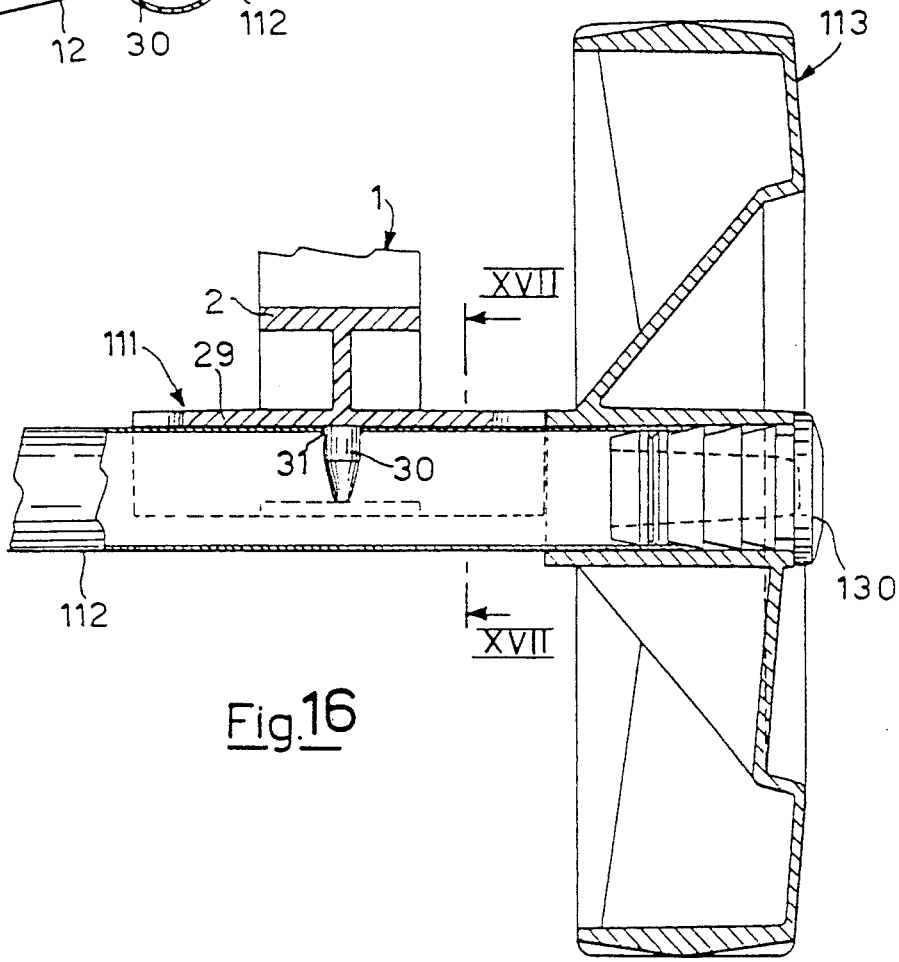
FIG. 16 is an axial cross-sectional view of a detail corresponding to the connection of the side of FIG. 2 to the wheel axis of the cart of FIG. 1.

FIGS. 16 and 17 show the coupling 111 in enlarged detail. Coupling 111 comprises a semicircular seat 29 at whose center there protrudes a centering pin 30 suitable for being inserted in a corresponding hole 31 of the shaft 112 supporting the pair of wheels 113. At each end of the supporting shaft 112 there is a locking cap 130.

During the assemblying stage, the free ends of the handle element 102 and of the base element 101 are inserted in the seats 7, 8, respectively, of the two sides 1 and locked therein by engagement of the teeth 26 in the cavities 27. The use of additional screws and nuts is thus avoided and the engagement is made stable and secure.

The shaft 112 supporting the pair of wheels 113 is snap-inserted in the connections 111 and centred in them by means of the engagement of the centering pins 30 in the holes 31. At the ends of the shaft 112 the wheels 113 are inserted, locked with the caps 130. This also does away with additional screws and nuts.

The drum 103 is in turn positioned with the hubs 106 in the couplings 9, locked with respect to them, again without screws and nuts, through the closing of the appendices 19 and the insertion of the corresponding protrusions 20 in the notches 23. The handle 110 is screwed on one of the two hubs 106 so as to operate the rotation of the drum 103 for winding or unwinding the flexible hose.

Although a side has been described for a cart with a hose-winding drum, the same side may be used for a wall-mounted hose winder. In such case, the handle element, as is obvious, shall be replaced by a suspension element. In addition, there shall be no wheels or the corresponding connecting shaft.

I claim:

1. A supporting side for a hose-winding drum for a device for winding flexible hose, having a shape substantially of a parallelogram with substantially parallel upper and lower peripheral edges and upwardly extending front and rear peripheral edges defining a flat body with two major surfaces, said body comprising a plurality of ribs parallel to each other and to said upper and lower peripheral edges, a succession of slots between each pair of said parallel ribs, said slots being elongated parallel to said ribs and having edges connected to each other and to said ribs by stiffening ribs, said body further comprising a first upwardly open seat arranged in said upper edge and provided with first coupling means for the introduction and connection of a respective substantially vertical end of a U-shaped handle tubular element, a second frontally open seat arranged at a lower end of said front edge and provided with second coupling means for the introduction and connection of a respective substantially horizontal end of a U-shaped base tubular element, a first passing-through hole formed in the body for rotatably accommodating a hub of a hose-winding drum and a second passing-through hole formed in the body provided with third coupling means for accommodating and connecting a wheel supporting shaft.

2. A side according to claim 1, wherein said first upwardly open seat and said first passing-through hole are located at two opposite ends of said upper peripheral edge, and said second passing-through hole and said second frontally open seat are located at corresponding opposite ends of said lower peripheral edge.

3. A side according to claim 1, wherein said first upwardly open seat and second frontally open seat comprise a semicylindrical surface, and both of their respective first and second coupling means comprise a tang which bridges the semicylindrical surface and ends with a tooth capable of fitting in a corresponding cavity in the respective end of the tubular element introduced therein.

4. A side according to claim 1, wherein said first passing-through hole comprises a semi-circular seat which receives said hub and an elastic holding element which is pivoted on one end of said seat and can be releasably snap-connected to another end of said seat.

5. A side according to claim 1, wherein said second passing-through hole comprises a semicircular seat for receiving said shaft, and said third coupling means comprise a centering projection, protruding from said semicircular seat, capable of fitting in a corresponding hole of the shaft.

6. A supporting side for a hose-winding drum for a device for winding flexible hose, comprising an upper upwardly open seat for the introduction and connection of a respective end of a U-shaped handle tubular element, a lower frontally open seat for the introduction and connection of a respective end of a U-shaped base tubular element, said upper and lower seats being arranged to define angularly intersecting introduction axes for said handle and base tubular elements, the side further comprising an upper passing-through hole for rotatably accommodating a hub of a hose-winding drum and a lower passing-through hole for accommodating a wheel supporting shaft.

7. A side according to claim 6, wherein said upper passing-through hole comprises a circular half-seat which receives said hub and an elastic holding element which is pivoted on one end of said half-seat and can be releasably snap-connected to another end of said half-seat.

8. A side according to claim 6, wherein said lower passing-through hole comprises a semicircular seat for receiving said shaft, and a centering projection, protruding from said semicircular seat, capable of fitting in a corresponding hole of the shaft.

9. A supporting side for a hose-winding drum for a device for winding flexible hose, comprising a passing-through hole provided with coupling means for rotatably accommodating a hub of a hose-winding drum, wherein said passing-through hole comprises a semi-circular seat suitable for receiving said hub and said coupling means comprise an elastic holding element which is pivoted on one end of said seat and can be releasably snap connected to another end of said seat.

* * * * *